United States Patent [19]

Vink et al.

[11] Patent Number: 5,001,390

[45] Date of Patent: Mar. 19, 1991

[54] COMBINATION OF A DISPLAY TUBE AND A DEFLECTION UNIT, WITH REDUCED NORTH-SOUTH RASTER ERROR

[75] Inventors: Nicolaas G. Vink; Franciscus C. A. J. Jacobs; Franciscus M. P. P. Doomernik, all of Eindhoven, Netherlands

[73] Assignee: U.S. Philips Corporation, New York, N.Y.

[21] Appl. No.: 416,081

[22] Filed: Oct. 2, 1989

[30] Foreign Application Priority Data

Oct. 6, 1988 [NL] Netherlands ..... 8802448

[51] Int. Cl.[5] ..... H01J 29/70

[52] U.S. Cl. ..... 313/440; 313/431; 335/211; 335/213

[58] Field of Search ..... 313/431, 440; 335/211, 335/213

[56] References Cited

U.S. PATENT DOCUMENTS 3,246,192 4/1966 Torsch ..... 313/440 X

*Primary Examiner*—Donald J. Yusko
*Assistant Examiner*—John E. Giust
*Attorney, Agent, or Firm*—Robert J. Kraus

[57] ABSTRACT

Deflection unit for use with a color display tube in which the line deflection coils are of the saddle type and have a front flange which is formed in such a way that a central portion has a part located closest to the axis of the display tube and being parallel to the surface of the display tube and a part located farthest away from the axis of the display tube and being transverse to the axis of the display tube, such that the north-south raster error is reduced.

5 Claims, 2 Drawing Sheets

COMBINATION OF A DISPLAY TUBE AND A DEFLECTION UNIT, WITH REDUCED NORTH-SOUTH RASTER ERROR

BACKGROUND OF THE INVENTION

The invention relates to a color display tube having an electromagnetic deflection unit coaxially surrounding the display tube, which unit comprises a field deflection coil system and a line deflection coil system, the line deflection coil system having two diametrically arranged flared line deflection coils of the saddle type with a front flange at the widest end and with two longitudinal conductors packets extending symmetrically relative to the axis of the display tube.

Increasingly strict requirements are imposed on the performance of color display tubes having electromagnetic deflection units particularly when they are used in monitors. Stringent requirements are imposed, for example on the shape of the raster.

In conventional TV receiver sets or in monitor sets a raster is formed by causing an electron beam to scan the front plate of the display tube. The (geometrical) raster errors which may occur are north-south raster errors (errors on the upper and lower side of the raster) and east-west raster errors (errors on the right and left-hand side of the raster). In color display tubes having an in-line arrangement of the electron guns the north-south raster errors becomes manifest as a certain waviness of the upper and lower edge of the raster ("second harmonic distortion"). To reduce this error, it is known from U.S. Pat. No. 4,229,720 to give the front flange of each line deflection coil, which flange is transverse to the axis of the display tube, the shape of a polygon. The vertices are positioned in such a way that field components are generated when energizing the line deflection coil, which components reduce the north-south raster error. This solution was later found to have the drawback that the polygonal flange shape gives rise to loss of energy on the one hand and generates unwanted radiation on the other hand. An advantage of the (polygonal) front flange transverse to the axis of the display tube is, however, that it provides a reference plane in the axial (z) direction when mounting the line deflection coil, so that an accurate adjustment of the z position which is required for a satisfactory color purity, is possible.

SUMMARY OF THE INVENTION

It has an object of the invention to provide a combination of a display tube and a deflection unit which has a reduced north-south raster error and a good color purity without the above-mentioned drawbacks occurring.

To this end the combination of color display tube and deflection unit of the type described in the opening paragraph is characterized in that the front flange at the widest end of each line deflection coil is formed in such a way that a central portion has a part located closest to the axis of the display tube and parallel to the surface of the display tube and a part which is located farthest away from the axis of the display tube and being transverse to the axis of the display tube while the flange portions adjacent to the central portion are transverse to the axis of the display tube, such that the north-south raster distortion is reduced.

Since the invention uses line deflection coils having a front flange which is "kinked" in the center, it is possible to generate the field components which are required to reduce the north-south raster error and to adjust the z position accurately.

More particularly it is possible to give the outer boundary of the front flange of each line deflection coil a circular shape so that loss of energy and emission of unwanted radiation is prevented to a large extent, as compared with a front flange having a polygonal shape.

The part of the central portion (the "kinked" part) of the front flange which is closest to the axis of the display tube and which is suitable in practice appears to be banana-shaped or arcuately shaped.

The thickness of the "banana" determines the strength of the positive six-pole component which is generated when energizing the line deflection coil system. The north-south raster error is reduced by adjusting this positive six-pole component.

The length of the "banana" determines the strength of field components of an order which is higher than six, which components are generated when energizing the line deflection coil system. A good convergence performance is realized by adjusting these higher order field components and the second harmonic distortion of the north-south raster is compensated for.

BRIEF DESCRIPTION OF THE DRAWINGS

An embodiment of the invention will be described in greater detail with reference to the accompanying drawing in which corresponding elements in the figures have the same reference numerals.

DESCRIPTION OF THE PREFERRED EMBODIMENT

Figure 1:
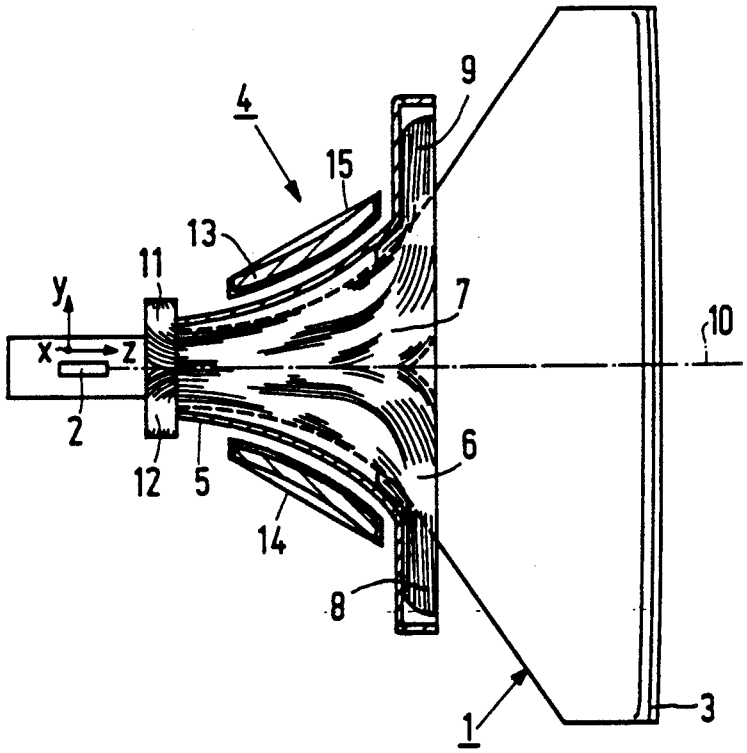
FIG. 1 shows diagrammatically a display tube with a deflection unit.

FIG. 1 shows a color display tube 1 having an electron gun system 2 or generating three electron beams directed towards a display screen 3 having a repetitive pattern of red, green and blue phosphor elements. An electromagnetic deflection unit 4 surrounding the path of the electron beams is arranged between the electron gun system 2 and the display screen 3. The deflection unit 4 has a funnel-shaped synthetic material coil support 5 which supports a line deflection coil system 6, 7 on its inner side. The flared line deflection coils 6, 7 are of the saddle type and have a front flange 8, 9 at their widest end, which flange extends substantially transversely to the axis 10 of the display tube. At their narrowest end the coils 6, 7 have packets of connection wires 11, 12 which interconnect the axial conductor packets of each coil 6, 7 and are laid across the surface area of the display tube 1. Consequently, in the case shown the coils 6, 7 are of the type having a "lying" rear flange and an "upstanding" front flange. Alternatively, they may be of the type having an "upstanding" rear flange and an "upstanding" front flange.

At its outer side the coil support 5 supports a funnel-shaped annular core 13 of a soft magnetic material on which two field deflection coils 14, 15 are toroidally wound in the case shown. Alternatively, the coil support 5 may support field deflection coils of the saddle type on its outer side, which coils are coaxially surrounded by the annular core 13.

Figure 2:
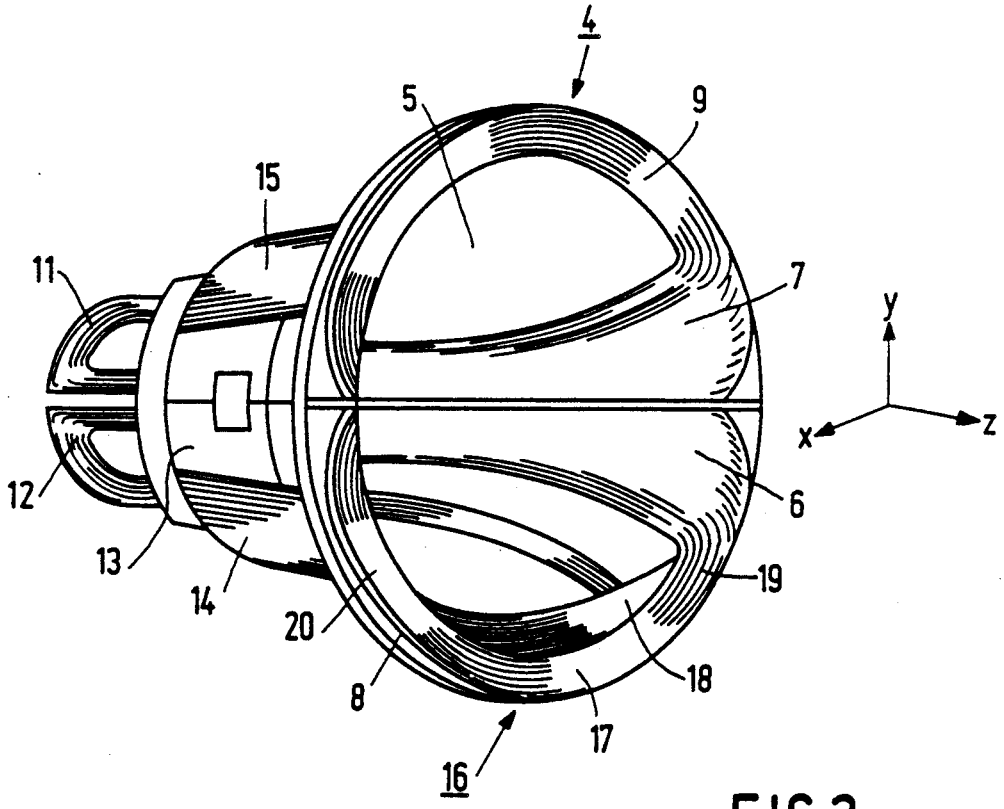
FIG. 2 is an elevational view of the deflection unit of FIG. 1 comprising a set of line deflection coils.
Figure 3:
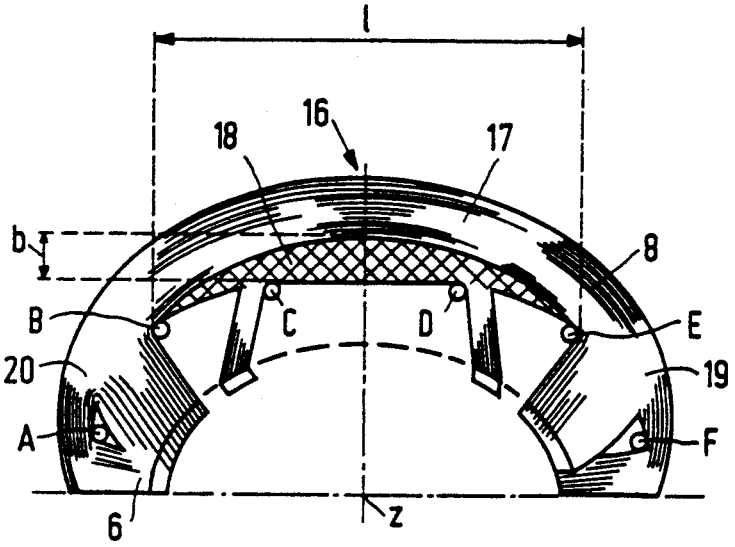
FIG. 3 is a rear view of a cross-section through the line deflection coil of FIG. 2.
Figure 4:
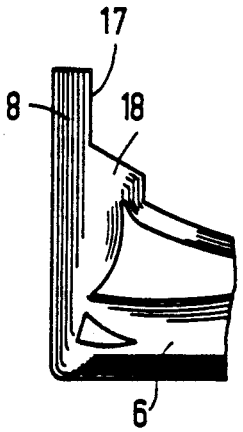
FIG. 4 is a side elevation of a portion of the line deflection coil of FIG. 3.

The deflection unit 4 is shown in greater detail in FIG. 2. This Figure shows that the front flange 8 of the line deflection coil 6 has a central portion 16 with a part 17 which, similarly as the portions 19 and 20 adjacent to the central portion is transverse to the z axis (this provides the possibility of mounting the line deflection coil 6 against a fixed abutment on the support 5) and a part 18 which is kinked and is parallel to the surface of the display tube 1 when the deflection unit 4 has been mounted on the display tube 1. All this is illustrated in FIG. 3 which is a rear view of a cross-section through the line deflection coil 6. The kinked part 18 of the front flange 8 approximately has the shape of a banana. This shape is realized by the shape of the jig which is used for winding the coil 6 and by placing the pins C and D further to the rear, which pins form part of the pins A, B, C, D, E, F which are introduced into the winding jig during winding so as to form a plurality of longitudinal turn sections. The other pins are positioned to the front during winding, such that a front flange is obtained which is transverse to the longitudinal axis of the coil. For a description of a winding device to be used for such a winding process reference is made to GB-A No. 1,497,696. The dimension b of the kinked part 18 determines the strength of the positive six-pole deflection field component with which the north-south raster error is reduced. The dimension 1 determines the strength of deflection field components of an order which is higher than six. This provides the possibility of controlling the convergence and the second order north-south raster distortion.

The peripheral shape of the front flange 8 of the line deflection coil 6 may be circular as is shown in FIGS. 2 and 3, because the modification of the flange required for reducing the north-south raster error is effected, according to the invention, by kinking a part of the central portion of the front flange. The use of a non-circular front flange, particularly a polygonal front flange as is known from U.S. Pat. No. 4,229,720 is then obviated.

Important aspects of the invention are briefly summarized as follows:

the kinked front flange is formed during winding, not during a post-processing step (pressing);

the outer circumference of the kinked front flange is substantially circular;

the front flange turns are partly in a plane perpendicular to the axis of the tube and partly in a plane parallel to the surface of the tube;

due to the combination of winding in sections and kinking a part of the front flange, turn sections having different lengths are obtained.

We claim:

1. A color display tube apparatus comprising an electromagnetic deflection unit coaxially surrounding a display tube, said unit including a field deflection coil system and a line deflection coil system, the line deflection coil system having first and second diametrically opposed, flared line deflection coils of the saddle type, each of said coils having a front flange at a widest end and first and second longitudinal conductor packets extending symmetrically relative to an axis of the display tube, characterized in that the front flange at the widest end of each line deflection coil is formed in such a way that a central portion has a part located closest to the axis of the display tube and substantially parallel to the surface of the display tube, a part located farthest away from the axis of the display tube and substantially transverse to the axis of the display tube, and flange portions adjacent to the central portion transverse to the axis of the display tube, such that the north-south raster distortion is reduced.

2. A display tube as claimed in claim 1, characterized in that an outer boundary of the front flange of each line deflection coil is circular.

3. A display tube as claimed in claim 1 or 2, characterized in that the part of the central portion of each line deflection coil which is located closest to the axis of the display tube is arcuate-shaped.

4. A display tube as claimed in claim 1 or 2, characterized in that the part of the central portion of each line deflection coil which is located closest to the axis of the display tube has a width which effects generation of a positive six-pole field component of a desired strength when energizing the line deflection coil system.

5. A display tube as claimed in claim 1 or 2, characterized in that the part of the central portion of each line deflection coil which is located closest to the axis of the display tube has a length which effects generation of deflection field components of an order higher than six and of a desired strength when energizing the line deflection coil system.

* * * * *